United States Patent [19]

Knorr

[11] Patent Number: 4,843,355

[45] Date of Patent: Jun. 27, 1989

[54] PROGRAMMABLE MECHANICAL DELAY LINE

[75] Inventor: Siegfried G. Knorr, Los Angeles, Calif.

[73] Assignee: Colby Instruments, Inc., Santa Monica, Calif.

[21] Appl. No.: 207,070

[22] Filed: Jun. 14, 1988

[51] Int. Cl.[4] ..... H01P 9/00; H01P 1/18

[52] U.S. Cl. ..... 333/160; 333/156; 333/245

[58] Field of Search ..... 333/160, 156, 245, 263, 333/23

[56] References Cited

U.S. PATENT DOCUMENTS 2,437,067 3/1948 Bingley ..... 333/160

OTHER PUBLICATIONS

McAllister-"A Variable-Length Radio-Frequency Transmission-Line Section", Journal of Scientific Instruments, vol. 28, Issue-5, May 1951, pp. 142-143.

*Primary Examiner*—Marvin L. Nussbaum

*Attorney, Agent, or Firm*—Ashen, Golant, Martin & Seldon

[57] ABSTRACT

A programmable mechanical delay line is disclosed comprising one or more lengths of axially movable co-axial cable. The inner and outer conductors of the cable length are respectively accepted within cavities having electrically conductive inner walls. The conductors are electrically coupled to the cavity walls by respective toroidal springs which circumvent the conductors and which contact the cavity walls at their outer diameter. The minimal surface contact by the toroidal springs reduces wear and friction. The reduction in friction substantially eliminates overshoot which previously resulted from attempts to rapidly reposition the coaxial cables. Consequently, the disclosed device provided very rapid, repeatable, and accurate adjustment as different amounts of signal delay are desired.

12 Claims, 2 Drawing Sheets

PROGRAMMABLE MECHANICAL DELAY LINE

BACKGROUND OF THE INVENTION

This invention relates to mechanical delay lines and, more specifically to mechanical delay lines wherein a coaxial cable is moved axially with respect to a contact member to effect a change of the cable's effective electrical length.

The principal and purpose of such devices are well known in the art. By proper mechanical positioning of the cables, the effective electrical length of the co-axial conductors can be changed to provide a desired phase shift to establish a desired time-delay between the application of a signal to the input end of the conductors and the emergence of the signal from the output end.

Examples of related devices are illustrated and described in U.S. Pat. Nos. 2,379,047; 2,407,147; and 2,468,147. The first of these patents shows two concentric conductors 16, 17 whose effective length is varied by means of an axially movable contact in the form of a spring 2 carried by a carrier nut 8, which is mounted on a lead screw driven by a controllable motor. The spring 2 occupies the space between the two concentric conductors 16, 17, and short-circuits the two conductors at the position to which it is moved.

U.S. Pat. No. 2,468,147 discloses a co-axial line having an outer conductor 1 and an inner conductor 2. A slidable sleeve 3 is mounted for axial movement about the central conductor 2, and terminates in a piston-like head 4 inside the coaxial section. As the sleeve 3 is moved by a rack and pinion arrangement, the piston head 4 couples the inner and outer conductors at a changing position along the length of the conductors.

U.S. Pat. No. 2,407,147 shows a device in which a short-circuiting member 37 has fingers 22 contacting an outer cylindrical conductor 10, and fingers 21 contacting an inner cylindrical conductor 11.

In addition to the foregoing devices, presently available mechanical delay lines are known wherein semi-rigid coaxial cables are moved axially into and out of a coaxial cavity, to change the location at which their inner and outer coaxial conductors are contacted by respective, non-moving elements within the housing. The change in location of the contacting members along the cable changes the effective electrical length of the coaxial conductors. These devices are sold by such companies as Arra Inc. (Bay Shore, N.Y.), Sage Laboratories, Inc. (Natick, Mass.) and Precision Tube Company, Inc. (North Wales, Pa.). These mechanical "delay lines" are sometimes referred to as "phase shifters", and it is understood that the two terms are also used interchangeably herein.

The use of known mechanical delay lines has been limited by wear-related problems, as well as by difficulties in precisely setting the position of the movable coaxial cable to achieve the desired delay with absolute accuracy.. The wear-related problems have arisen most noticably from the sliding contact of the shorting elements against the coaxially-extending conductors. Consequently, mechanical delay lines have been used for relatively few applications, wherein the number and frequency of adjustments is minimal. Typically, such adjustments were made only once for a fixed phase adjustment. Adjustment methods have included screwdriver-type adjustments, micrometer adjustments, or the use of a slow moving motor.

SUMMARY OF THE INVENTION

The present invention is directed to a programmable delay line wherein the amount of delay may be precisely controlled, and wherein the desired delay may be frequently adjusted. The device herein is a mechanical delay line comprising one or more semi-rigid coaxial cables which can be moved axially to adjustably position the coaxial conductors in the cable with respect to contacting members which are resiliently movable in the radial direction. The radially resilient contact members maintain gentle but firm contact with the coaxial conductors as the coaxial cable is moved axially, and are minimally dimensioned in the axial direction. The result is a minimization of both static and sliding friction between the conductors and the contacting surfaces.

The lessened friction not only permits the amount of delay imposed by the device to be adjusted more frequently, by lengthening the device's life expectancy, but also permits the use of a precisely controllable, high resolution stepper motor to accurately and quickly position the conductors with respect to the contact surfaces, thereby obtaining the precise amount of delay desired.

The reduction in static friction, in particular, permits the delay to be rapidly, but accurately, adjusted. When cables are subjected to rapid axial movement, sufficient force must be generated to overcome the static friction which resists such movement. Once static friction is overcome, and movement commences, a relatively lesser amount of "sliding friction" opposes the movement. Thus, the rapid generation of a force sufficiently strong to overcome a substantial amount of static friction inherently produces an overshooting in cable position when movement begins and the force is opposed only by the lesser sliding friction. Since sliding friction decreases with velocity, the difference between static and sliding friction has been minimized in the past by permitting only slow axial movement of the cables. Accordingly, micrometer adjustments and slow motors have been used, as previously described.

The reduction in static friction, experienced by the invention herein, substantially eliminates the overshooting which inherently results when the cable is moved rapidly to rapidly adjust the delay. The stepper motor may conveniently be controlled by a programmable computer interface or a programmable microterminal. The programmable interface may, in turn, be either manually programmable, as through a keyboard, or computer controlled.

More specifically, the device disclosed herein comprises at least one axially-extending length of semi-rigid coaxial cable of the type having a generally central, axially-extending, inner conductor surrounded by a generally circumferential, axially extending, outer conductor. First and second coaxial connectors are provided for electrically coupling respective ends of the coaxial cable to respective circuit elements external to the mechanical delay line. Accordingly, each coaxial connector has inner connector means and outer connector means for electrically coupling the inner and outer coaxial conductors to respective circuit elements.

First contact surface means are electrically coupled to a selected one of the inner and outer connector means of a selected one of the coaxial connectors for contacting an axially narrow underlying segment of the central conductor at a selected end of the coaxial cable. As indicated above, the first contact surface means is resiliently movable in the radial direction by the changing dimensions of the central coaxial conductor, so as to maintain gentle but firm contact with the central conductor as the coaxial cable is moved axially.

Second contact surface means are electrically coupled to the other of the connector means of the selected coaxial connector for contacting an underlying segment of the outer conductor at the selected end of the coaxial cable. The second contact surface means is resiliently movable in the radial direction by changing dimensions of the outer coaxial conductor to maintain gentle but firm contact with the outer conductor as the coaxial cable is moved axially.

Means are also provided for respectively coupling the inner and outer conductors at the non-selected end of the coaxial cable to different ones of the inner and outer connector means of the non-selected coaxial connector.

Control means, by causing relative axial movement between the coaxial cable and the first and second contact surface means, controllably varies the effective length of the coaxial cable disposed between the first and second coaxial connectors. Consequently, a signal applied to one end of the coaxial conductor is delayed by a controllable amount of time by changing the length of conductor that the signal must pass through before it emerges from the other end of the conductor.

Additional details concerning the invention will be appreciated from the following description of the preferred embodiment, of which the following drawing forms a part.

DESCRIPTION OF THE PREFERRED EMBODIMENT

Figure 1:
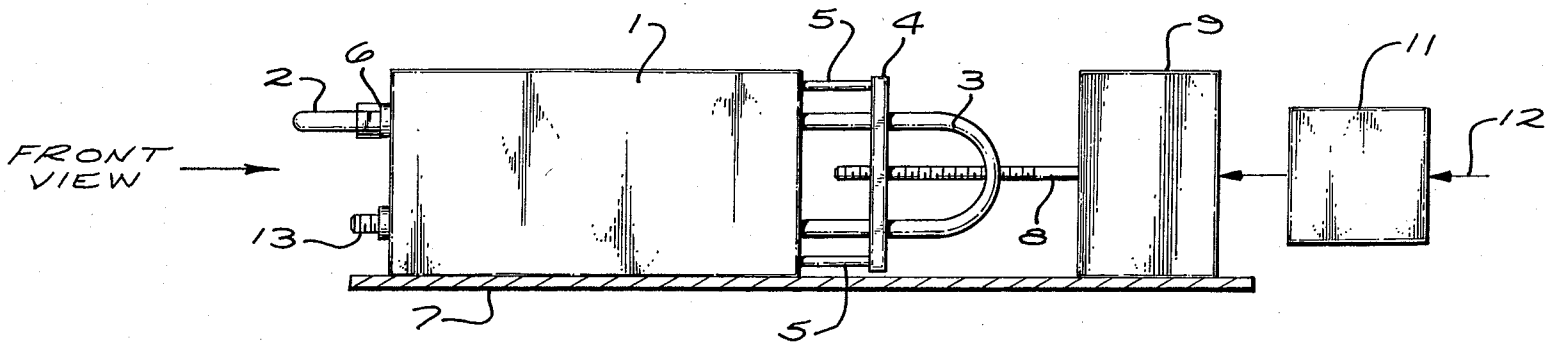
FIG. 1 is a side view in schematic of a programmable delay line assembly constructed in accordance with the invention.

FIGS. 1–4 show the exterior of a programmable delay line assembly constructed in accordance with the invention. The assembly comprises a housing 1 into which a pair of axially-extending, semi-rigid coaxial cables are moved axially by a stepper motor 9 acting through a rotatable threaded rod 8. The rod 8 engages a cable-engaging plate 4 to push or pull the plate axially. The plate's movement towards and away from the housing is guided by four guide rods 5, which are supported by respective low-friction bearings within the housing.

As is known in the art, each of the semi-rigid coaxial cables typically comprises a solid or stranded wire inner conductor surrounded by a polyethylene dielectric, or other electrical insulating material. A tubular, electrically conductive outer conductor, typically formed from copper, encompasses the dielectric and inner conductor. The resulting cable is minimally flexible, and is described herein as being "semi-rigid".

Figure 3:
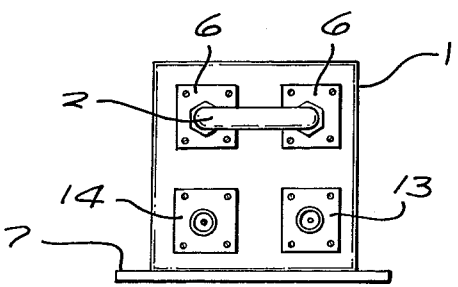
FIG. 3 is a front view in schematic of a programmable delay line assembly constructed in accordance with the invention.

As shown in FIG. 3, the front of the illustrated assembly includes four coaxial connectors. Specifically, an input coaxial connector 14 and an output coaxial connector 13 extend through the front of the housing 1 near the bottom of the assembly, while a second pair of coaxial connectors 6 extend through the front of the housing near top of the assembly. Each of the coaxial connectors comprises inner and outer connection surfaces which are insulated from each other, and which are adapted to electrically couple to the central and outer conductors of the coaxial cable, respectively.

Figure 2:
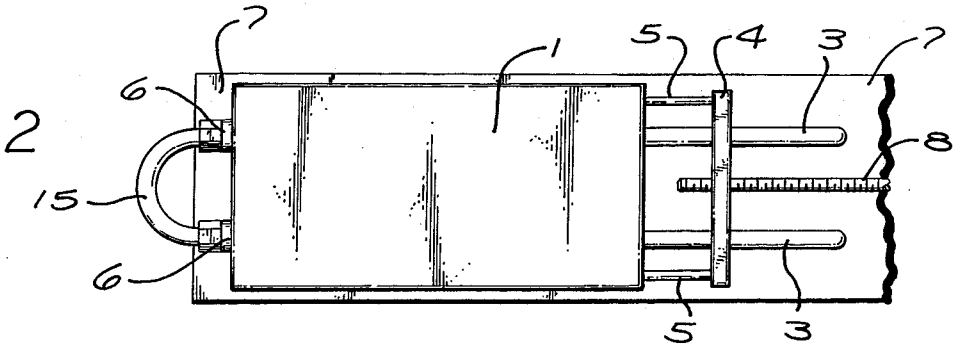
FIG. 2 is a top view in schematic of a programmable delay line assembly constructed in accordance with the invention.
Figure 4:
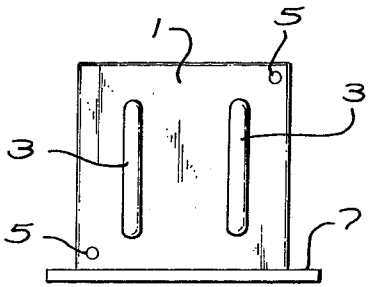
FIG. 4 is a back view in schematic of a programmable delay line assembly constructed in accordance with the invention.

As shown best in FIGS. 1 and 2, the pair of coaxial cables 3 are each formed into a generally "C"-shaped loop, with their respective ends positioned within the housing 1. The ends of one of the cables are respectively coupled to the input connector 13 and the top left connector 6 (FIG. 3), in a manner discussed below and illustrated in FIG. 5. The other coaxial cable is similarly coupled between the output connector 13 and the top right connector 6. Accordingly, both cables may be conveniently connected in electrical series by a length of coaxial cable 15 which connects both the inner connector portions of the two top coaxial connectors 6 together, and also connects the two outer connector portions of the connectors together. As will be appreciated, the serial connection of the two cables 3 results in a doubling of the unit change in delay for each unit of cable movement.

Figure 5:
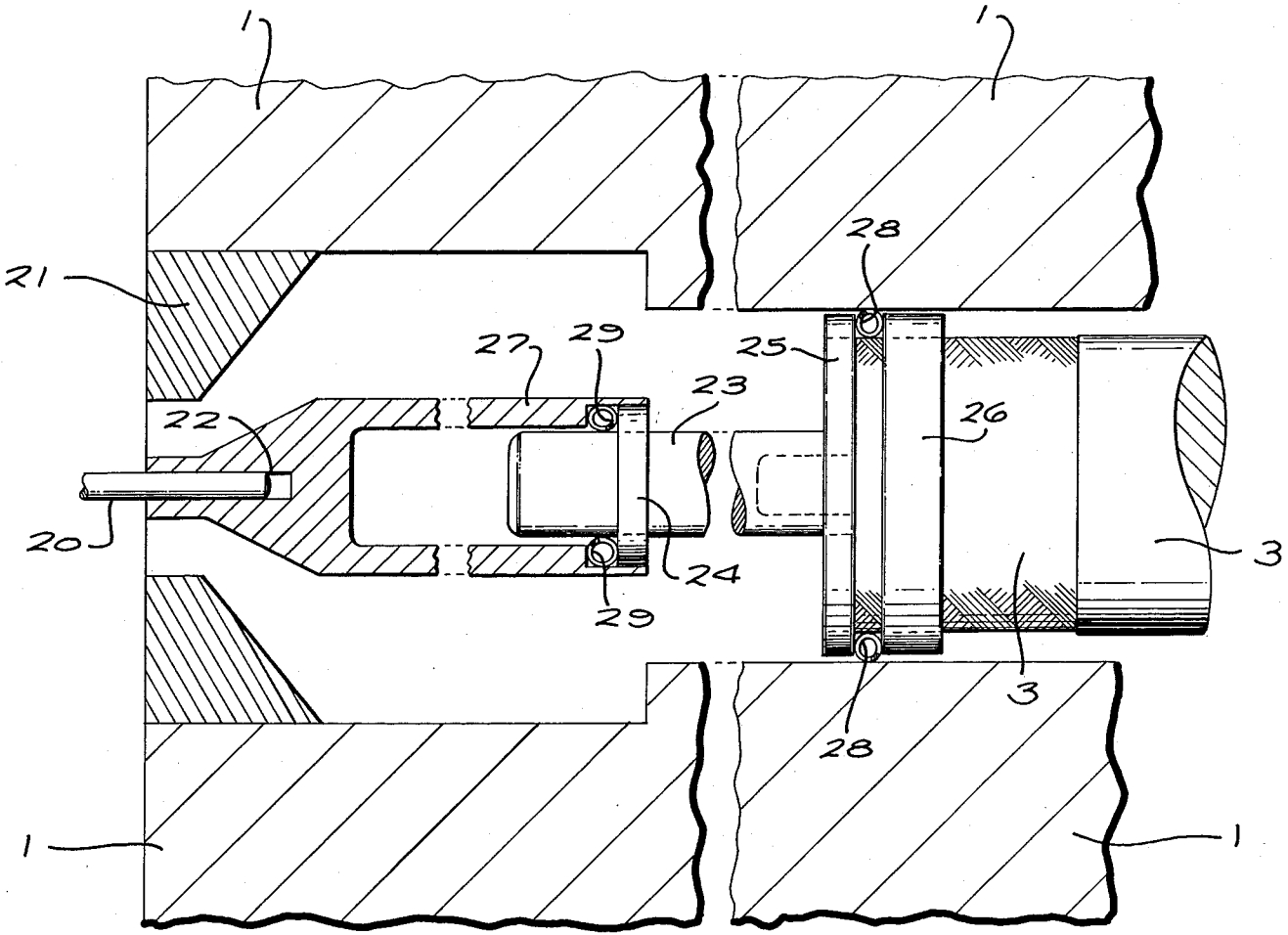
FIG. 5 is a magnified sectional view side view showing the electrical coupling of a a representative end of an axially movable coaxial cable to a coaxial connector associated with the device of FIGS. 1–4.

FIG. 5 is a sectional side view, showing the manner by which each end of each coaxial cable 3 is coupled to a coaxial connector. The coaxial connector is preferably a standard high-frequency SMA flange bulkhead connector, comprising a central pin 20 which extends axially into the housing's connector to connect the central conductor 3*a* of the coaxial cable 3 to external circuit elements. The peripheral portion 30 of the coaxial connector is electrically insulated form the central pin 20 and is adapted to electrically couple the outer coaxial conductor 3*b* to respective external circuit elements. A cone ring 21 is positioned inside the housing, and adjacent the connector, to match the proper impedance level to the connector.

The coaxial cable 3, with its central conductor 3*a* protruding axially beyond the outer conductor 3*b*, extends into a socket 31, the walls of which are electrically coupled to the outer portion of the coaxial connector. The outer coaxial conductor 3*b* makes electrical contact with the socket wall via an electrically conductive torroidal spring 28 circumventing the outer conductor 3*b*. The torroidal spring 28 is held in place about the cable between a pair of supporting rings 26, 26 soldered to the outer coaxial conductor. The socket 31 has a sufficiently large cross section so that no portion of the coaxial cable contacts the socket walls. Generally, a clearance of 0.010 inches between the outer conductor and the socket wall is satisfactory. Accordingly, the only contact with the wall is made by the outer periphery of the torroidal spring 28.

The torroidal spring 28 is preferably formed from stainless steel and plated with rhubidium for maximum wear. A torroidal spring manufactured by Bal Seal Engineering Co., Inc. as Part No. X13592 has been found satisfactory. Because the socket wall is contacted only by the radially outer-most surfaces of the wire which forms the coils, minimal static and sliding friction is generated by this minimal surface contact. Friction is further reduced, and non-uniformities in socket diameter are compensated for, by the coiled structure of the wire, which deforms resiliently in the radial direction to firmly but gently contact the socket wall throughout the range of axial movement by the coaxial cable 3.

The central coaxial conductor 23 is similarly coupled to the inner connector of the coaxial connector by a torroidal spring 29. The torroidal spring 29, which may conveniently be the device manufactured by Bal Seal Engineering Co., Inc. as Part No. X13594, is captured by a supporting ring 24 within a stationary, conductor-accepting receptacle 27 extending axially inwardly from the central coaxial connector. The receptacle 27, is sized to accept the axially movable conductor 3*a* with approximately 0.010 inches of clearance. The torroidal spring 29 nests within a counterbore 32 at the conductor-accepting end of the receptacle, and circumvents the inner coaxial conductor 3*a*. The internal diameter of the torroidal spring is slightly smaller than that of the receptacle, so that the torroidal spring's inner peripheral surface contacts the inner conductor 3*a*, forming a low friction contact surface which electrically couples the underlying portion of the coaxial cable 3 to the coaxial connector 20.

The torroidal spring 29 is captured within the counterbore by a generally coaxially mounted support ring 29, which is epoxied onto the conductor-accepting end of the receptacle. The inside diameter of the support ring 29 is sufficient to permit the inner coaxial conductor to pass through untouched, while the surface area between its inside diameter and outside diameter abuts the torroidal spring 29.

As the coaxial cable 3 moves axially with respect to the coaxial connector, electrical contact is made with the inner coaxial conductor at a changing location along its length, thereby changing the electrical length of the inner conductor between the input and output coaxial connectors 14, 13 (FIG. 3). Because torroidal spring 28 moves with the cable 3, the effective electrical length of the outer coaxial conductor 3*b* remains the same. Consequently, the axial movement of the cable 3 causes a change in phase (or delay) between the signal carried by the inner conductor 3*a* with respect to the signal carried by the outer coaxial conductor 3*b*.

The substantial reduction in friction, attributable to the coupling technique described above, permits the cable to be moved frequently by means of a precisely controlled stepper motor capable of high resolution and accuracy. In practice, it has been found that a computer-controlled or keyboard-controlled stepper motor can be used to vary the delay by the line by as much as 625 picoseconds within a 0.5 second interval, when the two "C"-shaped coaxial cable loops are coupled in series as illustrated. The foregoing delay change corresponds to a phase shift in the propagated signal of 225o/GHz. If one desires, instead, to have two identical parallel delay lines formed by the two cables, the delay in each can be varied by 312.5 picoseconds within the 0.5 second interval.

Because sliding contacts are restricted to the two torroidal spring members, substantially longer life expectancy is obtained, together with greater reliability than that exhibited by presently known devices. Consequently, delay adjustments may be made more often, lending the device to new circuit applications. Accuracy of the preferred embodiment has been found to be 0.1%±0.25 picoseconds over its entire range.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. For use in an electrical circuit, a device for providing an adjustable delay line and comprising:

a plurality of generally axially extending lengths of semi-rigid coaxial cables, each being of the type having a generally central, generally axially extending, inner conductor surrounded by a generally circumferential, generally axially extending, outer conductor;

a like plurality of cable-encompassing cavities, each being dimensioned to loosely accept the axially movable selected end of a respective coaxial cable, each cavity including an electrically conductive inner wall portion;

a like plurality of coaxial connectors, each having central connector means adapted to be electrically coupled to a respective inner coaxial conductor, and each further including outer connector means adapted to be coupled to a respective outer coaxial conductor, each of the outer connector means being electrically coupled to the electrically conductive inner wall of the respective cavity;

means for coupling selected inner connector means together to serially connect the inner conductors of respective coaxial cables, and for coupling the related outer connector means together to serially connect the outer conductors of the respective coaxial cables;

means for moving the plurality of coaxial cable lengths axially;

a like plurality of conductor-accepting receptacles electrically coupled to the inner connector means of each coaxial connector, each receptacle having a conductor-accepting cavity dimensioned to loosely accept the axially movable inner coaxial conductor;

first electrically conductive torroidal spring means circumventing the outer coaxial conductor and having an outer radial dimension sized for sliding contact with the electrically conductive inner wall portion of the cable-encompassing cavity to electrically couple the outer coaxial conductor thereto, the first torroidal spring means being fixedly positioned on the axially movable outer conductor for electrical coupling thereto, and being relatively thin in the axial direction to minimize sliding friction therewith during axial movement of the coaxial cable; and second electrically conductive torroidal spring means circumventing the inner coaxial conductor and having an outer radial dimension sized to contact the inner wall of the conductor-accepting cavity to electrically couple the inner coaxial conductor thereto, the second torroidal spring means having an inner radial dimension permitting sliding contact with the axially movable inner conductor, and being relatively thin in the axial direction to minimize sliding friction therewith during axial movement of the coaxial cable.

2. The device of claim 1 wherein the coaxial cables forming the plurality of lengths are each formed into generally "C"-shaped loops.

3. The device of claim 1 wherein the cable moving means includes:

a stepper motor responsive to a control signal;

a threaded rod rotated by the stepper motor; and axially movable support means coupled to the threaded rod for gripping the plurality of coaxial cables interjacent their respective ends and for moving the plurality of cables axially in response to rotation of the threaded rod.

4. For use in an electrical circuit, a device for providing an adjustable delay line and comprising:

at least one generally axially extending length of semi-rigid coaxial cable of the type having a generally central, generally axially extending, inner conductor surrounded by a generally circumferential, generally axially extending, outer conductor;

first and second coaxial connectors for electrically coupling respective ends of the coaxial cable to respective circuit elements, each coaxial connector having inner connector means and outer connector means for electrically coupling respective ends of the inner and outer conductors of the coaxial cable to respective circuit elements, the inner connector means including an axially-extending first contact surface radially displaced from the inner conductor to define a first gap therebetween, the outer connector means including an axially-extending second contact surface radially displaced from the outer conductor to form a second gap therebetween;

first toroidal spring means fixedly coupled to the contact surface of a selected one of the connector means and generally circumscribing an axially narrow circumferential segment of the coaxial conductor associated therewith for electrical contact therewith, the first toroidal spring means being radially resilient so as to maintain gentle but firm contact with the circumscribed segment as the coaxial cable is moved axially with respect to the first toroidal spring means;

second toroidal spring means electrically coupled to the other of the connector means and fixedly mounted about a circumscribed segment of the coaxial conductor associated therewith, the second toroidal spring means being radially resilient to maintain gentle but firm contact with the contact surface of the other conductor means as the coaxial cable is moved axially;

control means for creating relative axially-directed movement between the coaxial cable and the first and second contact surface means to controllably vary the effective length of the coaxial cable disposed between the first and second coaxial connectors.

5. The device of claim 4 wherein at least one of the toroidal spring means is an electrically conductive annulus of coiled wire.

6. The device of claim 5 wherein the wire is formed from stainless steel.

7. The device of claims 5 or 6 wherein the wire is plated with a wear resistant, electrically conductive material.

8. The device of claim 7 wherein the wear resistant, electrically conductive material is rhodium.

9. The device of claim 4 wherein the inner connector means includes a conductor-accepting receptacle having a cavity dimensioned to loosely accept the axially movable inner coaxial conductor, the first toroidal spring being captured within the cavity to present generally the sole surface therein which contacts the central conductor of the coaxial cable.

10. The device of claim 9 wherein the cavity of the receptacle is of smaller cross dimension than the outer diameter of the first toroidal spring, the receptacle includes a counterbored conductor-receiving end of sufficiently large cross dimension to accept the first toroidal spring, and the device further includes support ring means having an exterior cross dimension approximately that of the counterbored end of the receptacle, and mounted therein coaxially with the first toroidal spring to capture said spring within the counterbored end of the receptacle.

11. The device of claim 10 wherein the I.D. of the toroidal spring is slightly smaller than the internal cross dimension of the cavity.

12. The device of claim 4 wherein the outer connector means includes a conductor-accepting receptacle having a cavity dimensioned to loosely accept the axially movable outer coaxial conductor, the content surface being formed along a wall of the cavity, the device further including a pair of support ring means circumventing the outer coaxial conductor and axially spaced from each other to firmly capture the second toroidal spring therebetween, the second toroidal spring presenting generally the sole surface which contacts the contact surface.

* * * * *